US008596737B2

(12) United States Patent
Komoto et al.

(10) Patent No.: US 8,596,737 B2
(45) Date of Patent: Dec. 3, 2013

(54) INK-JET RECORDING APPARATUS

(75) Inventors: Masahiro Komoto, Toyoake (JP); Isao Fukuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 13 days.

(21) Appl. No.: 13/434,578

(22) Filed: Mar. 29, 2012

(65) Prior Publication Data

US 2013/0002759 A1 Jan. 3, 2013

(30) Foreign Application Priority Data

Jun. 30, 2011 (JP) ..... 2011-146224

(51) Int. Cl.
*B41J 25/308* (2006.01)

(52) U.S. Cl.
USPC ..... 347/8; 347/37; 347/39

(58) Field of Classification Search
USPC ..... 347/8, 37, 39
See application file for complete search history.

(56) References Cited

U.S. PATENT DOCUMENTS

2010/0026758 A1 2/2010 Tanaka et al.

FOREIGN PATENT DOCUMENTS

JP H10-337924 A 12/1998
JP 2007-185895 A 7/2007
JP 2010-052417 A 3/2010

OTHER PUBLICATIONS

Machine translation of JP 10-337924 A. (JP 10-337924 A was published on Dec. 22, 1998.).*

* cited by examiner

*Primary Examiner* — Matthew Luu
*Assistant Examiner* — Justin Seo
(74) *Attorney, Agent, or Firm* — Baker Botts L.L.P.

(57) ABSTRACT

An ink-jet recording apparatus including a carriage carrying a recording head for ejecting ink droplets, a support portion for supporting the carriage such that the carriage is reciprocally movable in a predetermined direction, a power transmission mechanism for transmitting a drive force from a drive power source to the carriage, and a vibration damping device disposed on the support portion, and wherein the vibration damping device has mutually different resonance frequency values at respective at least two different positions in the predetermined direction.

10 Claims, 10 Drawing Sheets

INK-JET RECORDING APPARATUS

CROSS REFERENCE TO RELATED APPLICATION

The present application claims the priority from Japanese Patent Application No. 2011-146224 filed Jun. 30, 2011, the disclosure of which is herein incorporated by reference in its entirety.

BACKGROUND OF THE INVENTION

1. Field of the Invention

The present invention relates to an ink-jet recording apparatus having a recording head which is mounted on a reciprocally movable carriage and which configured to eject droplets of an ink on a recording medium for forming an image on the recording medium.

2. Description of Related Art

There is known an ink-jet recording apparatus having a recording head configured to eject droplets of an ink for forming an image on a recording medium, on the basis of input signals. The ink-jet recording apparatus has a carriage on which the recording head is mounted and which is disposed in opposition to the recording medium. The carriage is supported by a support portion or structure so as to be movable in a predetermined direction. During the movement of the carriage, the ink droplets are ejected from selected ones of nozzles of the recording head, to form the desired image on the recording medium.

The carriage is vibrated with vibrations of drive power sources and other components transmitted thereto through the support portion. The vibration of the carriage during a recording operation to form an image on the recording medium causes a variation of a distance between the recording head and the recording medium, and a consequent variation of positions of deposition of the ink droplets on the recording medium, resulting in deterioration of the quality of the image formed on the recording medium.

For solving the problem described above, a known image forming apparatus has a guide shaft which supports a carriage and which is provided with a vibration damping device having the same resonance frequency as the guide shaft. The vibration damping device functions to offset the vibration of the guide shaft, for reducing the vibration of the carriage.

SUMMARY OF THE INVENTION

However, the vibration damping device provided in the known image forming apparatus described above does not permit effective reduction of the vibration of the carriage, because the resonance frequency of the guide shaft varies according to the position of the carriage during its reciprocation while being supported by the guide shaft.

Where the guide shaft is supported at its opposite ends by a frame, for instance, a primary vibration of the guide shaft causes a variation of its resonance frequency, namely, causes of the resonance frequency of the carriage to be relatively low in a central portion of the guide shaft, that is, when the carriage is relatively distant from two points of support at which the guide shaft is supported at its opposite ends by the frame, and causes the resonance frequency of the carriage to be higher in an end portion of the guide shaft, that is, when the carriage is relatively close to one of the above-indicated two points of support.

Thus, the vibration damping device having a single resonance frequency in the above-described known image forming apparatus fails to effectively reduce the vibration of the carriage irrespective of the position of the carriage.

The present invention was made in view of the background art described above. It is therefore an object of the present invention to provide an ink-jet recording apparatus which has a reciprocally movable carriage and which is constructed to effectively reduce the vibration of the carriage irrespective of the position of the carriage.

The object indicated above can be achieved according to the principle of this invention, which provides an ink-jet recording apparatus comprising: a recording head configured to eject droplets of an ink; a carriage on which the recording head is mounted; a support portion configured to support the carriage such that the carriage is reciprocally movable in a first direction; a drive power source; a power transmission mechanism configured to transmit a drive force from the drive power source to the carriage; and a dynamic vibration absorbing device disposed on the support portion, and wherein the dynamic vibration absorbing device has mutually different resonance frequency values at respective at least two different positions in the first direction.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which:

FIG. 9B is a cross sectional view taken along line A-A in FIG. 5, while FIGS. 10A and 10B are front elevational views of the vibration damper 61, wherein FIG. 10A shows a single weight member 62 and a plurality of elastic members 63, while FIG. 10B shows a plurality of weight members 62 and a single elastic member 63.

DETAILED DESCRIPTION OF THE PREFERRED EMBODIMENT

Figure 1:
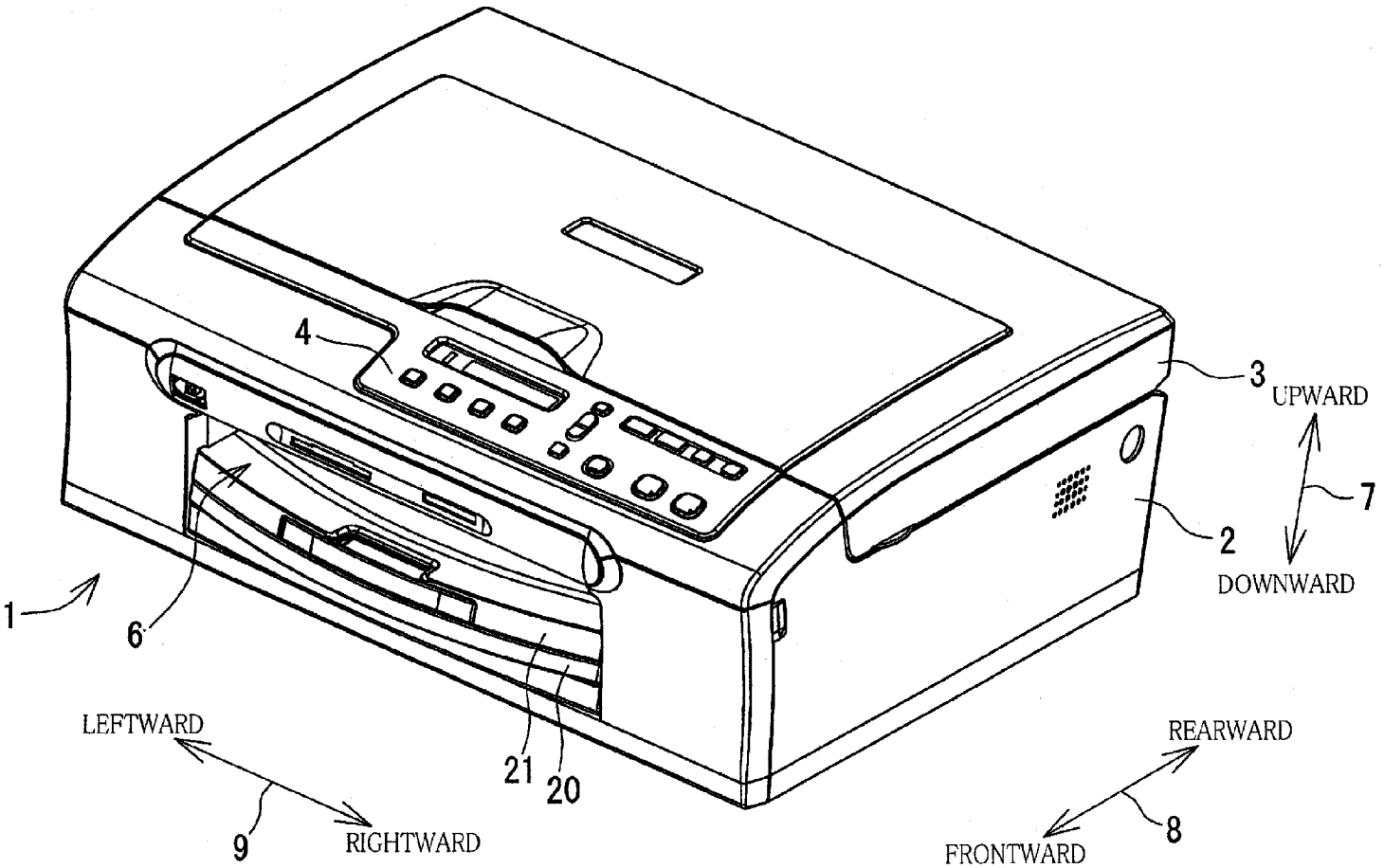
FIG. 1 is a perspective view showing an appearance of a multi-function apparatus 1 constructed according to one embodiment of this invention.

The preferred embodiment of this invention will be described by reference to the accompanying drawings. It is to be understood that the present embodiment will be described for illustrative purpose only, and that the present invention may be otherwise embodied. It is further to be understood that two arrow-headed lines given as vectors in the drawings respectively represent two opposite directions as seen in a vertical direction 7, a sheet feeding direction 8 and a transverse direction 9, and that the vertical direction 7 is defined with respect to an attitude of a multi-function apparatus 1 placed in its operative position of FIG. 1, and the sheet feeding direction 8 is defined as a direction from a front side of the multi-function apparatus 1 (on which an operator's control panel 4 and an opening 6 are provided) toward a rear side opposite to the front side, while the transverse direction 9 is defined as a right-and-left direction when the apparatus 1 is seen in the sheet feeding direction 8.

Multi-Function Apparatus 1

As shown in FIG. 1, the multi-function apparatus 1 is a multi-function product or peripheral (MFP) which has a generally rectangular box structure accommodating an ink-jet recording apparatus in the form of a printer portion 2 in its lower part and a scanner portion 3 in its upper part. The multi-function apparatus 1 has a plurality of functions including a printing function, a scanning function, a copying function and a facsimile function, of which only the printing function is essential in the ink-jet recording apparatus according to the present invention. In this respect, therefore, the present invention is applicable to a printer having only the printing function without the provision of the scanner portion 3, for example.

The printer portion 2 is configured to record an image on a recording medium, on the basis of printing data transmitted from an external information processing device such as an external computer. The printer portion 2 has the above-indicated opening 6 on its front side. In the opening 6, a sheet supply tray 20 and a sheet receiver tray 21 are accommodated in a two-stage stack. Sheets of paper accommodated in the sheet supply tray 20 are delivered therefrom one after another into the printer portion 2, so that the desired images are recorded on the paper sheets. The paper sheets on which the images have been recorded are ejected onto the sheet receiver tray 21.

The scanner portion 3 is of a so-called "flat bed" type. No further description of the scanner portion 3 is deemed necessary for understanding the present invention. The above-indicated operator's control panel 4 for manual operation of the printer portion 2 and other portions of the multi-function apparatus 1 is disposed on an upper part of the front side of the multi-function apparatus 1.

Sheet Supply Roller 25

Figure 2:
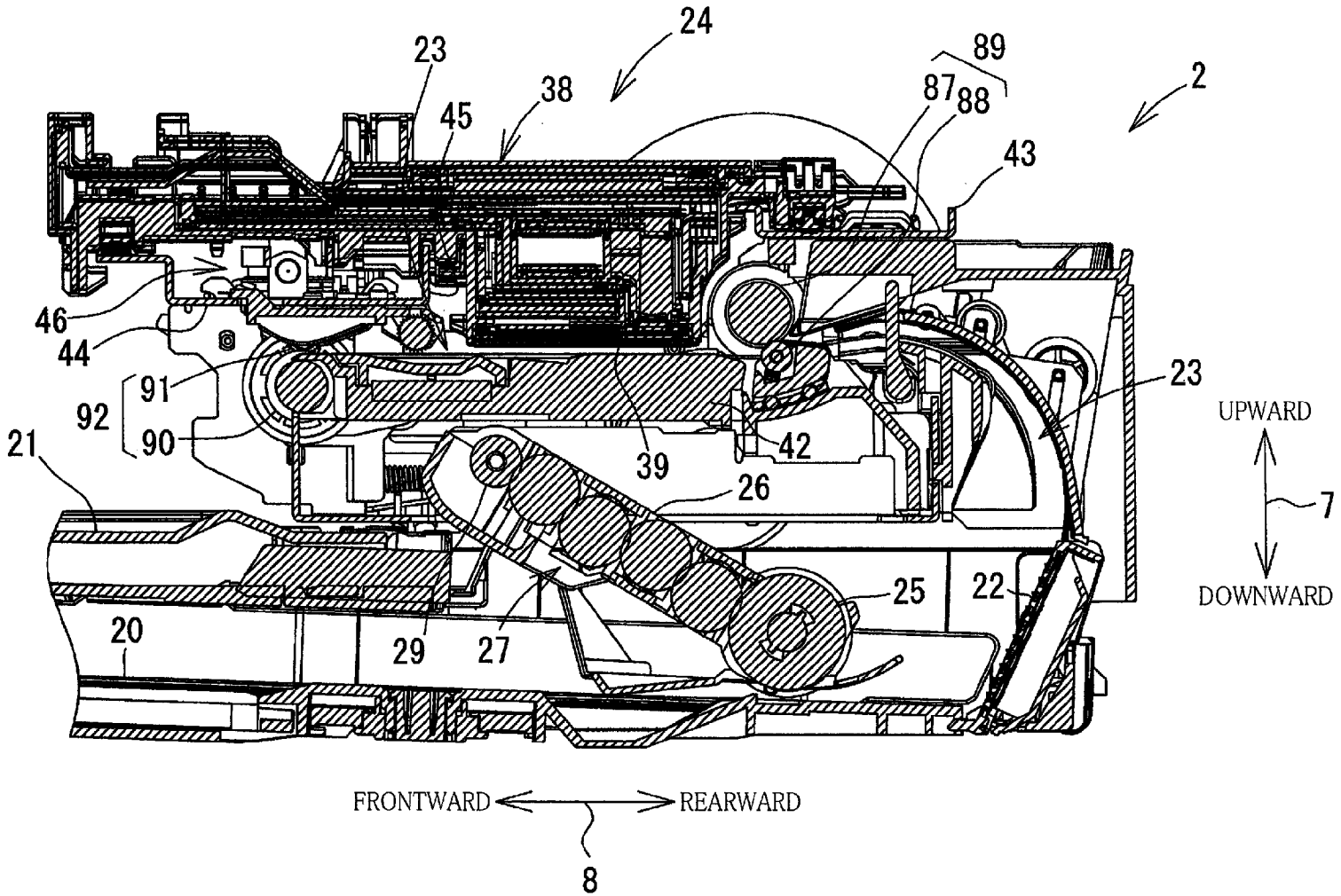
FIG. 2 is an enlarged fragmentary view in cross section showing major components of a printer portion 2 of the multi-function apparatus 1 of FIG. 1.

As shown in FIG. 2, the sheet supply tray 20 is disposed in the lower part of the multi-function apparatus 1. A sheet supply roller 25 is disposed above the sheet supply tray 20. The sheet supply roller 25 is rotatably supported at a distal end portion of a sheet supply arm 26, which is supported at a proximal end portion thereof pivotally about a support shaft 29. The sheet supply roller 25 is rotated by a drive power source in the form of a sheet supply motor (not shown) through a gear train 27.

On the rear side of the sheet supply tray 20, there is disposed an inclined plate 22. When the sheet supply roller 25 is rotated in pressing contact with an uppermost one of the paper sheets in the sheet supply tray 20 is fed toward the inclined plate 22, owing to a force of friction between the outer circumferential surface of the sheet supply roller 25 and the upper surface of the uppermost paper sheet.

Sheet Feeding Path 23

As also shown in FIG. 2, a sheet feeding path 23 is provided so as to extend from the inclined plate 22. Described more specifically, the sheet feeding path 23 is initially U-turned upwards along the inclined plate 22, and then extended horizontally from the rear side toward the front side of the multi-function apparatus 1, finally reaching the sheet receiver tray 21 while passing below a recording portion 24. Accordingly, the paper sheet delivered from the sheet supply tray 20 is guided upwards along a U-turned portion of the sheet feeding path 23, and is then guided horizontally under the recording portion 24 such that the paper sheet is finally fed onto the sheet receiver tray 21 after a recording operation of the recording portion 24 to form an image on the paper sheet.

Feed Roller Pair 89 and Ejector Roller Pair 92

Figure 4:
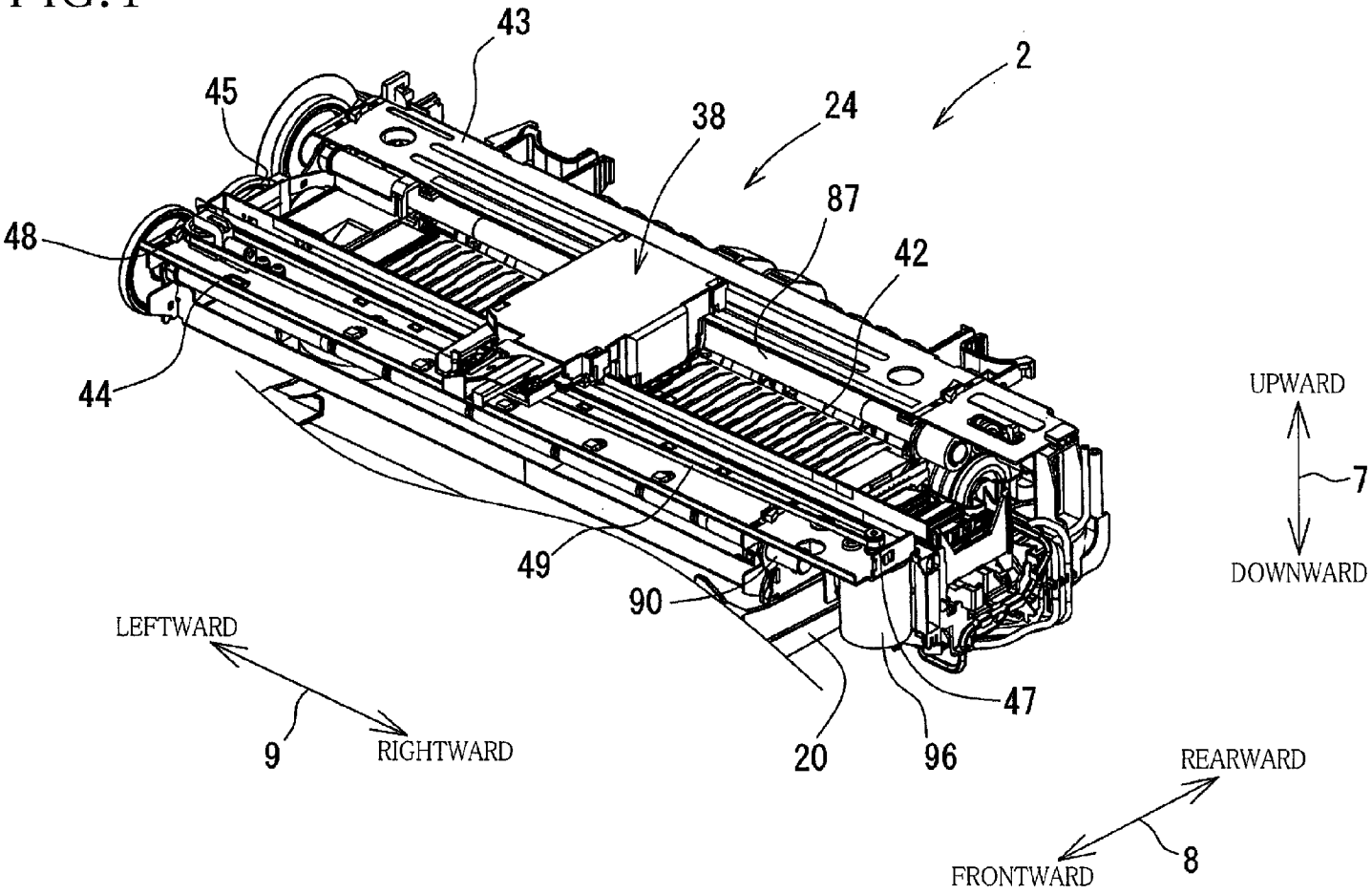
FIG. 4 is a perspective view showing major components of the printer portion 2.

As shown in FIGS. 2 and 4, a feed roller pair 89 consisting of a feed roller 87 ad a pinch roller 88 is disposed upstream of the recording portion 24, while an ejector roller pair 92 consisting of an ejector roller 90 and a spur wheel 91 is disposed downstream of the recording portion 24. The feed roller 87 is rotated by a sheet feeding motor (not shown) to intermittently feed the paper sheet by a predetermined incremental distance corresponding to each return movement of the carriage 38. The feed motor 87 and the ejector roller 90 are connected to each other through a transmission mechanism including gears, so that a rotary motion of the feed motor 87 is transmitted to the ejector roller 90 through the transmission mechanism. The paper sheet which has been fed along the sheet feeding path 23 is fed onto a platen 42 by the feed roller pair 89. After the image is formed on the paper sheet being supported by the platen 42, the paper sheet is further fed by the ejector roller pair 92 onto the sheet receiver tray 21. The platen 42 is disposed below the sheet feeding path 23, in opposition to the recording portion 24, for supporting the paper sheet being fed along the sheet feeding path 23.

Recording Portion 24

As shown in FIG. 2, the recording portion 24 disposed adjacent to the sheet feeding path 23 has a plurality of recording heads 39 of an ink-jet type, and a carriage 38 on which the recording heads 39 are mounted. The carriage 38 is supported slidably in a first direction that is the above-indicated transverse direction 9 (indicated in FIGS. 3 and 4) perpendicular to a second direction that is the above-indicated sheet feeding direction 8 (indicated in FIGS. 2 and 4).

The recording heads 39 are mounted on a lower surface of the carriage 38. Each of the recording heads 39 has nozzles (not shown) open in its lower surface and exposed downwards from the carriage 38. The recording heads 39 are supplied with inks of respective different colors from respective ink cartridges (not shown) housed within the multi-function apparatus 1. During sliding movements of the carriage 38, minute droplets of the inks of the different colors are ejected from selected ones of the nozzles of the recording heads 39, to record the desired image on the paper sheet being fed on the platen 42.

Figure 3:
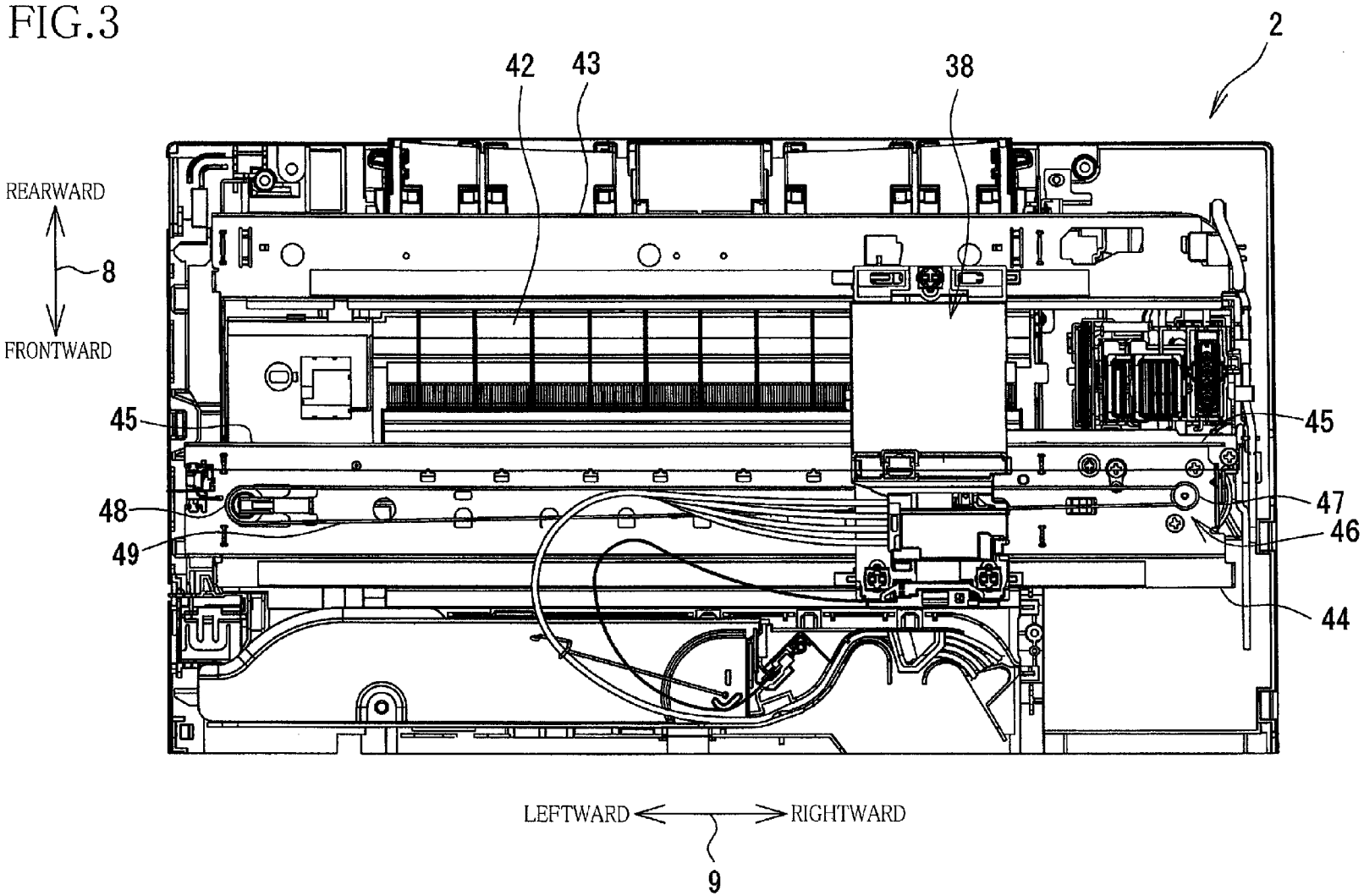
FIG. 3 is a plan view showing major components of the printer portion 2.
Figure 5:
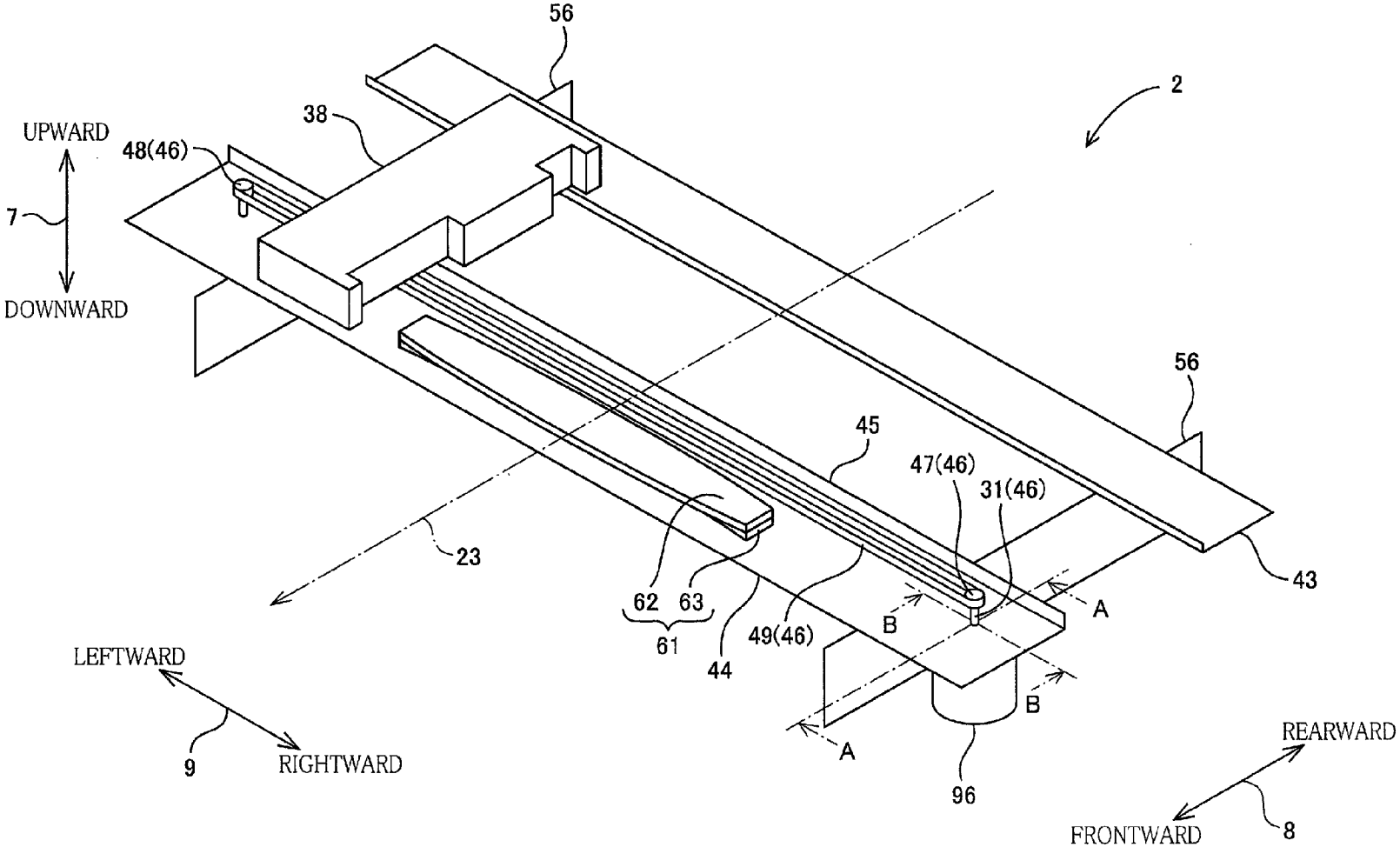
FIG. 5 is a perspective view schematically showing major components of the printer portion 2 provided with a vibration damper 61.

As shown in FIGS. 3-5, a first support portion in the form of a guide rail 44 and a second support portion in the form of a guide rail 43 are disposed so as to extend in the transverse direction 9 (first direction) in a plane above the sheet feeding path 23, such that the guide rails 43, 44 are spaced apart from each other by a predetermined distance in the sheet feeding direction 8 (second direction). Namely, the guide rails 43, 44 are spaced apart from each other by a predetermined distance in the second direction intersecting the first direction.

As shown in FIG. 5, the guide rails 43, 44 are supported at their opposite end portions as seen in the transverse direction 9, by respective two frames 56 of the multi-function apparatus 1, which extend in the sheet feeding direction 8. The two frames 56 are located outwardly of the right and left ends of a horizontal part of the sheet feeding path 23, in the transverse direction 9. The carriage 38 straddles on the guide rails 43, 44 such that the carriage 38 is slidably movable on the guide rails 43, 44 in the transverse direction 9. In other words, the guide rails 43, 44 constitute a support structure or portion configured to support the carriage 38 such that the carriage is reciprocally movable in the transverse direction 9.

As shown in FIGS. 3-5, the guide rail 43 is disposed upstream of the guide rail 44 in the sheet feeding direction 8. The guide rails 43, 44 take the form of elongate plates having lengths in the transverse direction 9, which is larger than a maximum distance of reciprocation of the carriage 38. The carriage 38 have upstream and downstream sliding surfaces in its respective upstream and downstream portions as seen in the sheet feeding direction 8, so that the upstream sliding surface slides on the guide rail 43 while the downstream sliding surface slides on the guide rail 44. Thus, the carriage 38 is slidably movable on the guide rails 43, 44 in their longitudinal direction.

The guide rail 44 has an upright upstream end wall 45 extending upright from its upstream end. The carriage 38 supported by the guide rails 43, 44 has nipping members such as rollers which slidably contact the opposite surfaces of the end wall 45, so that the carriage 38 is positioned in the sheet feeding direction 8 while the carriage 38 is slidably guided in the transverse direction 9 perpendicular to the sheet feeding direction 8. Thus, the carriage 38 is supported by the guide rails 43, 44 such that the carriage 38 is slidably and reciprocally movable in the transverse direction 9 while being guided by the upright upstream end wall 45 and the nipping members. The end wall 45 is coated with a grease or any other lubricating agent for smooth sliding motions of the carriage 38 in contact with the end wall 45.

Belt-Type Transmission Mechanism 46

A power transmission mechanism in the form of a belt-type transmission mechanism 46 is disposed on the guide rail 44. However, the belt-type transmission mechanism 46 may be disposed on the guide rail 43. The transmission mechanism 46 has a driving pulley 47, a driven pulley 48, and a belt member in the form of an endless belt 49. The driving pulley 47 is driven by a drive power source in the form of a carriage drive motor 96.

The driving and driven pulleys 47, 48 are disposed on and supported by the upper surface of the guide rail 44. The driving and driven pulleys 47, 48 are located near respective opposite ends of the horizontal part of the sheet feeding path 23, and are connected to each other by the endless belt 49. Thus, the endless belt 49 is disposed above the guide rail 44. The endless belt 49 may be replaced by a transmission member opposite ends of which are fixed to the carriage 38.

Figure 9A:
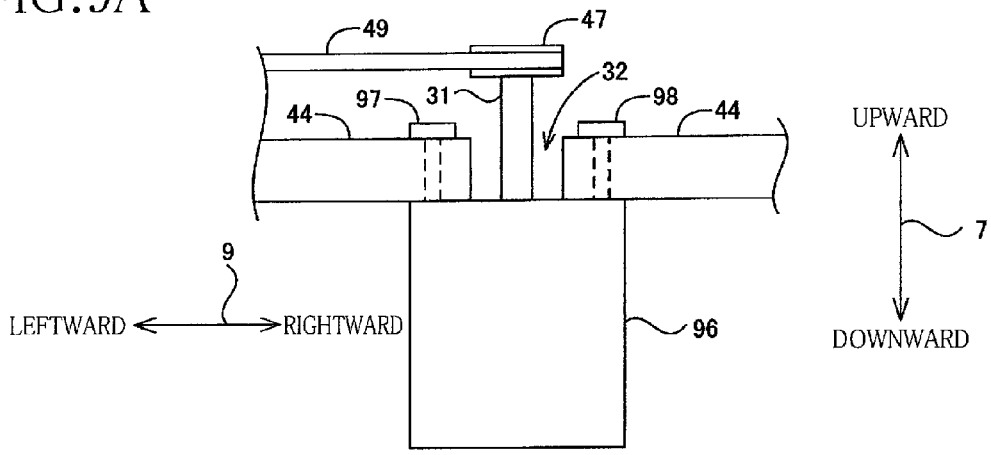
FIG. 9A is a cross sectional view taken along line B-B in FIG. 5.

As shown in FIG. 9A, the guide rail 44 has a hole 32, and the driving pulley 47 has a shaft 31 extending through the hole 32. As shown in FIGS. 4, 5 and 9A, the carriage drive motor 96 is disposed so as to close the lower open end of the hole 32. As shown in FIG. 9A, the carriage drive motor 96 is suspended from the guide rail 44 such that the carriage drive motor 96 is fixed to a lower surface of the guide rail 44 with screws 97, 98. The shaft 31 of the driving pulley 47 extending through the hole 32 is connected to a drive shaft of the carriage drive motor 96.

A rotary motion of the driving pulley 47 by a rotary motion of the drive shaft of the carriage drive motor 96 causes a rotary motion of the belt 49. Namely, the belt 49 is rotated by the carriage drive motor 96. The carriage 38 is connected at its bottom to the belt 49, so that rotary motions of the belt 49 in the opposite directions cause reciprocating movements of the carriage 38 on the guide rails 43, 44 in the transverse direction 9. That is, the belt-type transmission mechanism 46 is configured to transmit a drive force of the carriage drive motor 96 to the carriage 38.

Vibration Damper 61

As shown in FIG. 5, a vibration damper 61 is supported by the guide rail 44 such that the vibration damper 61 is disposed on an upper surface of the guide rail 44. It is noted that the vibration damper 61 is not shown in FIGS. 2-4.

In the present embodiment, the vibration damper 61 disposed on the guide rail 44 is considered as an ancillary vibration system while the guide rail 44 is considered as a primary vibration system which is subjected to vibrations of the carriage drive motor 96 and other components of the multi-function apparatus 1. The vibration damper 61 is configured to damp the vibration of the primary vibration system, by adjusting a force of the ancillary vibration system influencing the primary vibration system such that a phase angle of the force of the ancillary vibration system is opposite to that of a force acting on the primary vibration system, over a predetermined range of the vibration frequency.

In the present embodiment, each of the guide rails 43, 44 is vibrated in the vertical direction 7, with its right and left end portions being supported by and fixed to the frames 56. According to the present embodiment, the vibration damper 61 is provided to damp the vibration of the guide rail 44 in the vertical direction 7.

Figure 6:
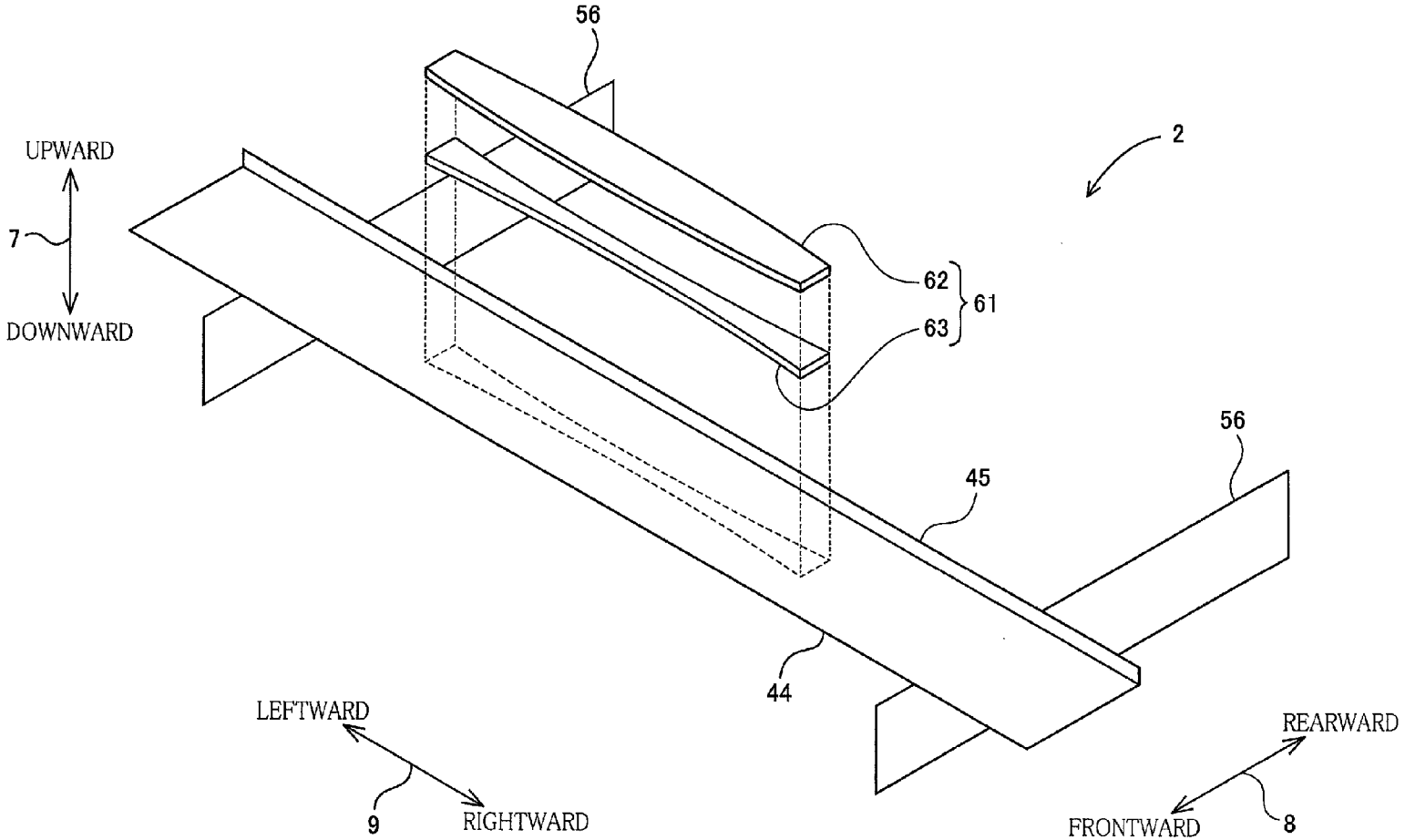
FIG. 6 is a perspective view schematically showing major components of the printer portion 2, where the vibration damper 61 is exploded into a weight member 61 and an elastic member 63.

As shown in FIG. 6, the vibration damper 61 is constituted by a weight member 62 and an elastic member 63. The weight member 62 is a metal plate formed of an iron, for example, while the elastic member 63 is a rubber plate, for example.

The weight member 62 and elastic member 63 are generally elongate, relatively narrow and thin plate members. In the present embodiment, the weight member 62 is a single one-piece member, and the elastic member 63 is also a single one-piece member.

The elastic member 63 is attached to the upper surface of the guide rail 44 such that the longitudinal direction of the elastic member 63 is parallel to the transverse direction 9, while the weight member 62 is superposed on the elastic member 63 such that the longitudinal direction of the weight member 62 is parallel to the transverse direction 9. Namely, the weight member 62 and elastic member 63 are attached to the guide rail 44 such that the elastic member 63 is sandwiched between the guide rail 44 and the weight member 62. The vertical direction 7, sheet feeding direction 8 and transverse direction 9 apply to the weight member 62 and elastic member 63, with respect to the attitudes of the weight and elastic members 62, 63 as attached to the guide rail 44, as indicated in FIG. 5.

Figure 9B:
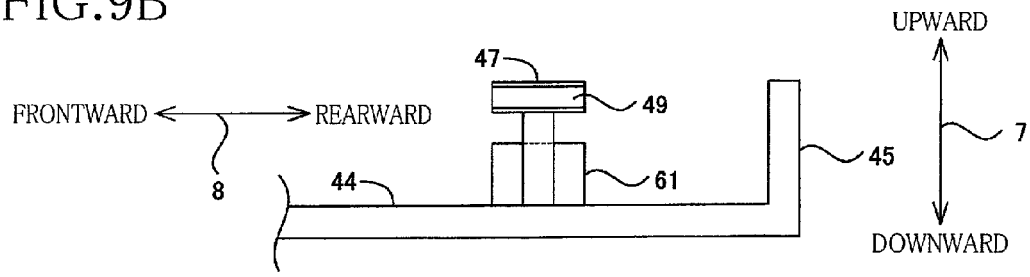

As is apparent from FIGS. 5 and 9B, the vibration damper 61 (weight member 62 and elastic member 63) is located at the same position as the belt 49 in the sheet feeding direction 8. Described more specifically, the vibration damper 61 is positioned right below the belt 49 connecting the driving pulley 47 and the driven pulley 48, that is, positioned between the belt 49 and the guide rail 44 in the vertical direction 7. In this connection, it is noted that only the guide rail 44, driving pulley 47, belt 49 and vibration damper 61 are shown in FIG. 9B.

As shown in FIG. 6, the width dimension of the weight member 62 in the sheet feeding direction 8 decreases in the opposite directions from its central portion toward its opposite end portions in the transverse direction 9, namely, increases in the opposite directions from the opposite end portions toward the central portion, while on the other hand the width dimension of the elastic member 63 in the sheet feeding direction 8 increases in the opposite directions from its central portion toward its opposite end portions, namely, decreases in the opposite directions from the opposite end portions toward the central portion.

As is apparent from FIGS. 5 and 6, the weight member 62 and elastic member 63 have the different width dimensions in the sheet feeding direction 8, over their entire length in the transverse direction 9, so that the vibration damper 61 has different resonance frequencies at each position (at each of different positions) in the transverse direction 9, as described below in detail. Thus, the vibration damper 61 is considered to include at least a first vibration damper located at a first position in the transverse direction 9, and a second vibration damper which is located at a second position spaced apart from the first position in the transverse direction 9 and which has a resonance frequency different from that of the first vibration damper. Each of these first and second vibration dampers is constituted by a weight member and an elastic member.

A significance of the configuration or geometry of each of the weight member 62 and the elastic member 63 will be described. Where the ancillary vibration system in the form of the vibration damper 61 is disposed on the primary vibration system in the form of the guide rail 44, the resonance frequency of the vibration damper 61 is represented by the following formula:

$$f=1/2\pi\sqrt{(k/m)}$$

In the above formula, "f" represents the resonance frequency of the vibration damper 61, and "k" represents a modulus of elasticity of the elastic member 63 per unit length in the transverse direction 9, while "m" represents a mass of the weight member 62 per unit length in the transverse direction 9. It will be understood from the formula that the resonance frequency f of the vibration damper 61 decreases with an increase of the mass m of the weight member 62 or with a decrease of the modulus of elasticity k of the elastic member 63, or with both of an increase of the mass m and a decrease of the modulus of elasticity k. It will also be understood that the resonance frequency f increases with a decrease of the mass m of the weight member 62 or with an increase of the modulus of elasticity m of the elastic member 63, or with both of a decrease of the mass m and an increase of the modulus of elasticity k.

In the present embodiment, the mass m of the weight member 62 is decreased by decreasing the width dimension of the weight member 62 in the sheet feeding direction 8, and increased by increasing the width dimension. However, the mass m of the weight member 62 may be changed by changing the thickness of the weight member 62 in the vertical direction 7.

In the present embodiment wherein the modulus of elasticity k of the elastic member 63 is a modulus of elasticity in the vertical direction 7 in which the guide rails 43, 44 are vibrated, the modulus of elasticity k is decreased by decreasing the width dimension of the elastic member 63 in the sheet feeding direction 8, and increased by increasing the width dimension. However, the modulus of elasticity k of the elastic member 63 may be changed by changing the thickness of the elastic member 63 in the vertical direction 7.

Figure 8:
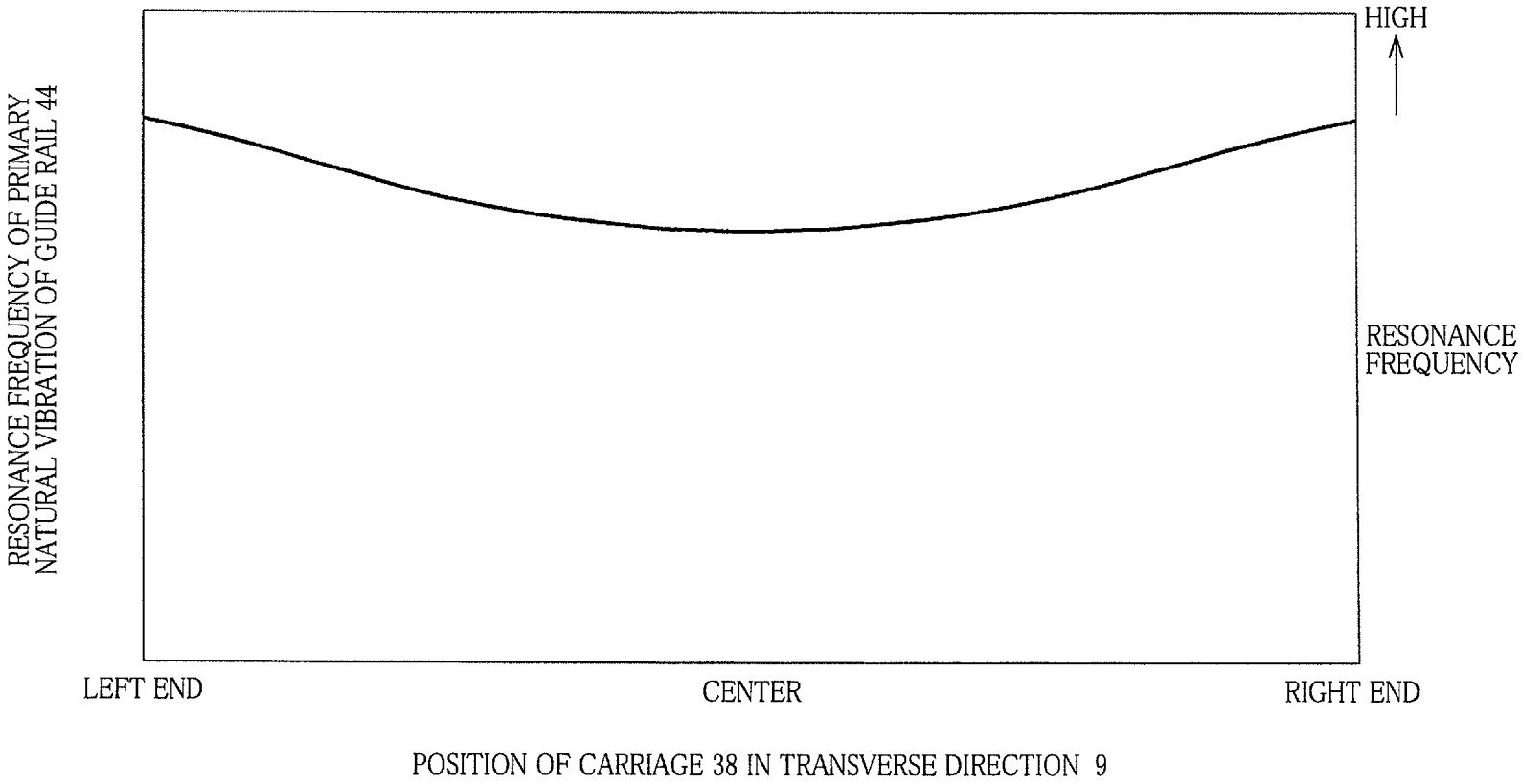
FIG. 8 is a graph indicating characteristics of a resonance frequency of a guide rail 44 in relation to the position of a carriage 38 in a transverse direction 9.

The applicants measured the resonance frequency of the primary natural vibration of the guide rail 44 at each position (different positions) of the carriage 38 in the transverse direction 9 in which the carriage 38 is slidably moved on the guide rails 43, 44. A result of the measurement is indicated in the graph of FIG. 8. It will be understood from this graph that the resonance frequency of the primary natural vibration of the guide rail 44 when the carriage 38 is located at the central portion in the transverse direction 9 is lower than that when the carriage 38 is located at the opposite ends in the transverse direction 9. Described more specifically, the resonance frequency of the primary natural vibration of the guide rail 44 decreases as the carriage 38 is moved from the opposite ends toward the central portion in the transverse direction 8.

In view of the above-indicated result of measurement of the resonance frequency of the guide rail 44, the vibration damper 61 according to the present embodiment is configured to increase its resonance frequency f from its central portion toward its opposite end portions in the transverse direction 9, and to decrease its resonance frequency f from its opposite end portions toward the central portion in the transverse direction 9.

Described in more detail, the width dimension of the weight member 62 of the vibration damper 61 in the sheet feeding direction 8 is decreased from the central portion of the weight member 62 toward its opposite end portions in the transverse direction 9, and increased in the opposite directions from the opposite end portions of the weight member 62 toward its central portion in the transverse direction 9, as shown in FIG. 6. Accordingly, the mass m of the weight member 62 is decreased in the opposite directions from its central portion toward its opposite end portions so that the resonance frequency f of the vibration damper 61 is increased in the opposite directions from its central portion toward its opposite end portions, and the mass m is increased in the opposite directions from the opposite end portions of the weight member 62 toward its central portion so that the resonance frequency f is decreased in the opposite directions from the opposite end portions of the vibration damper 61 toward its central portion.

Further, the width dimension of the elastic member 63 in the sheet feeding direction 8 is increased from the central portion of the elastic member 63 toward its opposite end portions in the transverse direction 9, and decreased from the opposite end portions of the elastic member 63 toward its central portion in the transverse direction. Accordingly, the modulus of elasticity k of the elastic member 63 is increased from its central portion toward its opposite end portions so that the resonance frequency f of the vibration damper 61 is increased from its central portion toward its opposite end portions, and the modulus of elasticity k is decreased from the opposite end portions of the elastic member 63 toward its central portion so that the resonance frequency f is decreased from the opposite end portions of the vibration damper 61 toward its central portion.

Although the present embodiment is configured to change the resonance frequency f of the vibration damper 61 in the transverse direction 9 by changing the width dimensions of both of the weight member 62 and the elastic member 63 (in the sheet feeding direction 8) in the transverse direction 9, the resonance frequency f may be changed in the transverse direction 9 by changing the width dimension of only one of the two members 62 and 63 while holding the width dimension of the other of the two members 62, 63 constant in the transverse direction 9.

In the present embodiment, the mass m of the weight member 62 and the modulus of elasticity k of the elastic member 63 are adjusted so that the resonance frequency f of the vibration damper 61 at each position in the transverse direction 9 coincides with the resonance frequency of the guide rail 44 when the carriage 38 is located at the same position in the transverse direction 9, that is, when the carriage 38 is opposed to the vibration damper 61 in the sheet feeding direction 9.

The vibration damper 61 configured as described above has different resonance frequency values f at respective different at least two positions in the transverse direction 9. It is particularly noted that the resonance frequency f of the vibration damper 61 at each position in the transverse direction 9 coincides with the resonance frequency of the guide rail 44 when the carriage 38 is located at the same position in the transverse direction 9. In other words, the resonance frequency of the above-described first vibration damper is equal to the resonance frequency of the guide rail 44 when the carriage 38 is located at the above-described first position, while the resonance frequency of the above-described second vibration damper is equal to the resonance frequency of the guide rail 44 when the carriage 38 is located at the above-described second position.

However, the resonance frequency f of the vibration damper 61 at each position in the transverse direction 9 need not be exactly equal to the resonance frequency of the guide rail 44 when the carriage 38 is located at the same position, but may be approximately equal to the resonance frequency of the guide rail 44 when the carriage 38 is located at the same position. The resonance frequency f of the vibration damper 61 approximately equal to that of the guide rail 44 is interpreted as follows: Namely, where the elastic member 63 takes the form of a rubber plate as in the present embodiment, the resonance frequency values f at the opposite ends of the guide rail 44 are higher by about 20% than that at the central position of the guide rail 44 in the transverse direction 9, as indicated in the graph of FIG. 8. For ensuring a sufficient advantage of the present embodiment, therefore, a difference of the resonance frequency f of the vibration damper 61 from the resonance frequency of the guide rail 44 must be held within a range of ±10%. This permissible range of the difference of the resonance frequency values of the vibration damper 61 and guide rail 44, which varies depending upon the configuration and material of the elastic member 63, must be determined by experimentation. It is also noted that the resonance frequency f of the vibration damper 61 need not be equal to the resonance frequency of the guide rail 44 over the entire range of movement of the carriage 38 in the transverse direction 9, but may be equal to the frequency of the guide rail 44 in only a predetermined portion of the entire range of movement of the carriage 38, and different from the frequency of the guide rail 44 in other portion of the entire range of movement of the carriage 38.

In the present embodiment, the resonance frequency of the guide rail 44 at each position in the transverse direction 9 is the resonance frequency of the primary natural vibration of the guide rail 44 when the carriage 38 is located at the same position. However, the resonance frequency of the guide rail 44 may be the resonance frequency of a vibration other than the primary natural vibration, for instance, a secondary natural vibration of the guide rail 44 when the carriage 38 is located at each position in the transverse direction 9. In this case, too, the resonance f of the vibration damper 61 is adjusted to coincide with the resonance frequency of the vibration other than the primary natural vibration of the guide rail 44.

Advantages of the Embodiment

The present embodiment described above is configured such that the vibration damper 61 has at least two different resonance frequency values f at respective at least two positions in the transverse direction 9, so that the vibration damper 61 can reduce the vibration of the guide rail 44 even where the guide rail 44 has at least two different resonance frequency values at respect at least two positions in the transverse direction 9. Thus, the vibration damper 61 can effectively damp the vibration of the carriage 38. That is, the present embodiment permits effective damping of the vibration of the carriage 38 irrespective of its position in the transverse direction 9.

The present embodiment is further configured such that the resonance frequency of the vibration damper 61 is equal to that of the guide rail 44 when the carriage 38 is located at any position in the transverse direction 9, so that the vibration damper 61 permits effective damping of the vibration of the guide rail 44 irrespective of the position of the carriage 38.

The guide rail 44 by which the belt-type transmission mechanism 46 is supported tends to be susceptible to the vibration of the carriage drive motor 96. In view of this tendency, the present embodiment is configured such that the vibration damper 61 is disposed on the guide rail 44, so that the vibration damper 61 permits effective damping of the vibration of the guide rail 44.

In the present embodiment, the vibration damper 61 is disposed right below the belt 49, namely, in a space between the guide rail 44 and the belt 49, so that the guide rail 44 can be made compact and small-sized, making it possible to prevent an increase in the size of the multi-function apparatus 1.

The present embodiment is further configured such that the vibration damper 61 is constructed as a unitary body that can be easily attached to the guide rail 44 in a relatively simple process.

First Modification

Figure 7:
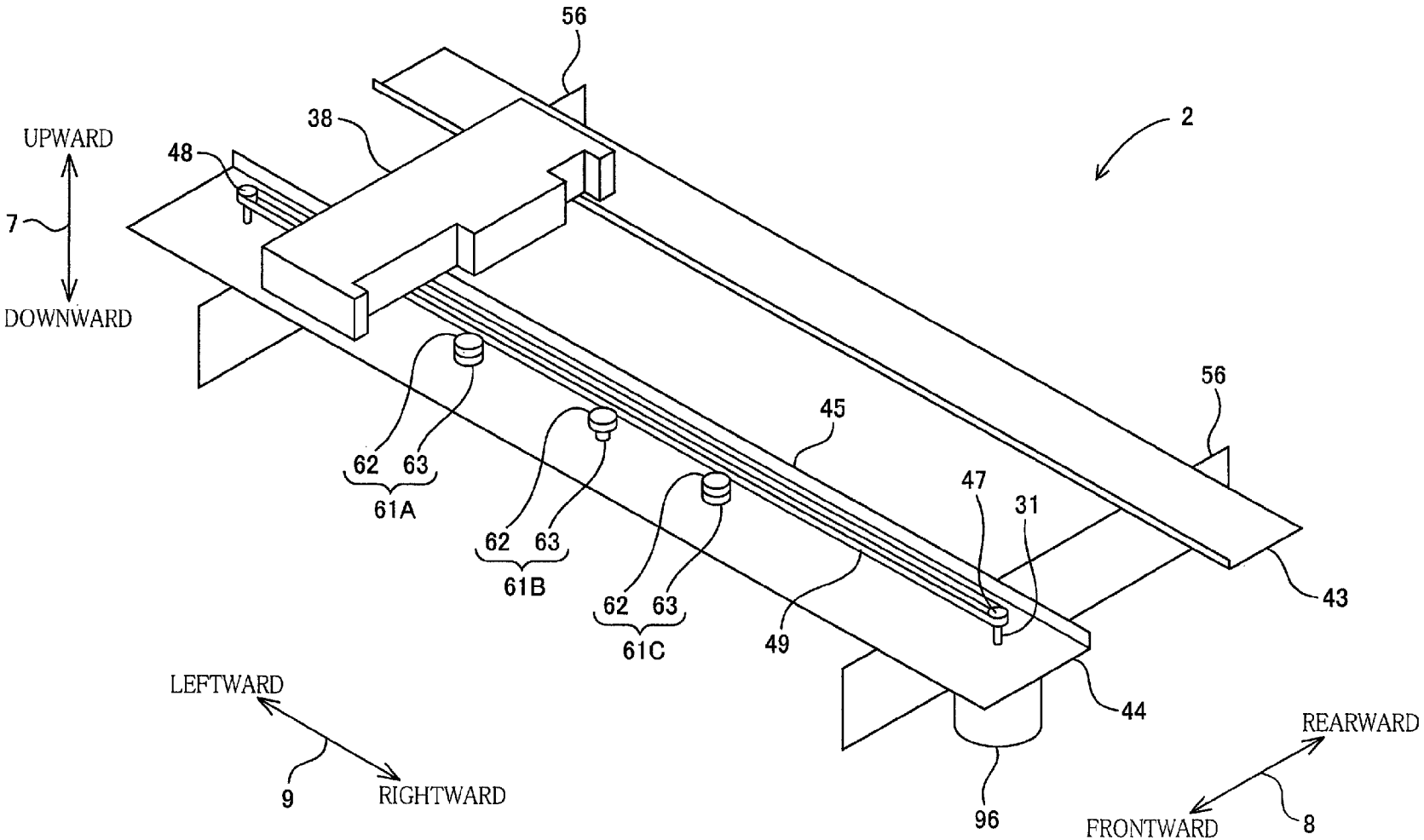
FIG. 7 is a perspective view schematically showing major components of the printer portion 2 provided with a plurality of vibration dampers 61A-61C.

In the illustrated embodiment described above, a dynamic vibration absorbing device in the form of the single dynamic vibration damper 61 consisting of the weight member 62 and the elastic member 63 is disposed on the guide rail 44. However, a plurality of vibration dampers may be disposed on the guide rail 44, to constitute a dynamic vibration absorbing device, as shown in FIG. 7.

For example, three cylindrical vibration dampers 61A, 61B and 61C may be disposed on the guide rail 44 such that the vibration dampers 61A-61C are spaced apart from each other in the transverse direction 9, and do not have a common one-piece member. In this modification, the elastic member 63 of the central vibration damper 61A has a diameter smaller than that of the elastic members 63 of the two outer vibration dampers 61B and 61C, so that the central vibration damper 61A has a resonance frequency lower than that of the outer vibration dampers 61B, 61C.

Thus, the dynamic vibration absorbing device according to the first modification is provided with the three separate vibration dampers 61A-61C arranged in the transverse direction 9.

The dynamic vibration absorbing device according to the first modification may be modified such that the three vibration dampers 61A-61C arranged in the transverse direction 9 have mutually different frequency values. The vibration dampers 61A-61C having respective resonance frequency values can be more easily fabricated than the dynamic vibration damper 61 having the plurality of resonance frequency values. The vibration dampers 61A-61C having the different resonance frequency values constitute a dynamic vibration absorbing device which has different resonance frequency values at respective different positions in the transverse direction 9.

Second Modification

The dynamic vibration absorbing system in the form of the vibration damper 61 in the illustrated embodiment consists of the single weight member 62 and the single elastic member 63. The dynamic vibration absorbing system according to the first modification consists of the three vibration dampers 61A-61C each consisting of the weight member 62 and the elastic member 63.

Figure 10A:
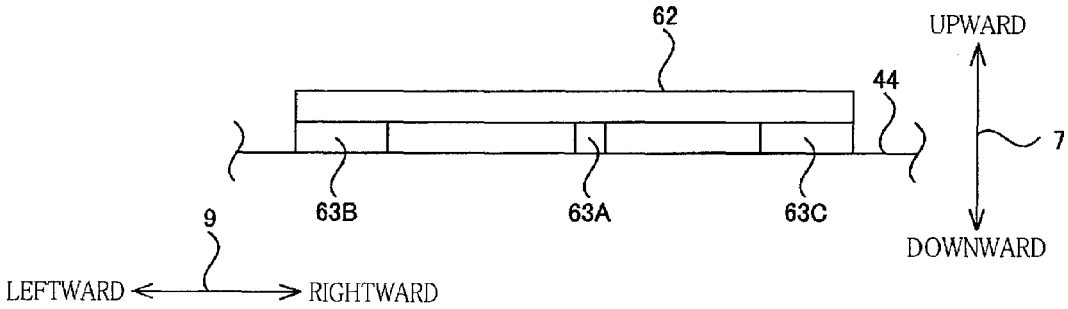

However, the dynamic vibration absorbing system may consist of the single weight member 62 and a plurality of elastic members 63, for instance, three elastic members 63A, 63B and 63C, as shown in FIG. 10A. In this modification, the central elastic member 63A has a diameter larger than that of the two outer elastic members 63B and 63C, so that the modulus of elasticity k of the dynamic vibration absorbing device is lower at its central portion than at its opposite end portions, whereby the dynamic vibration absorbing device has a lower resonance frequency at its central portion than at its opposite end portions.

Figure 10B:
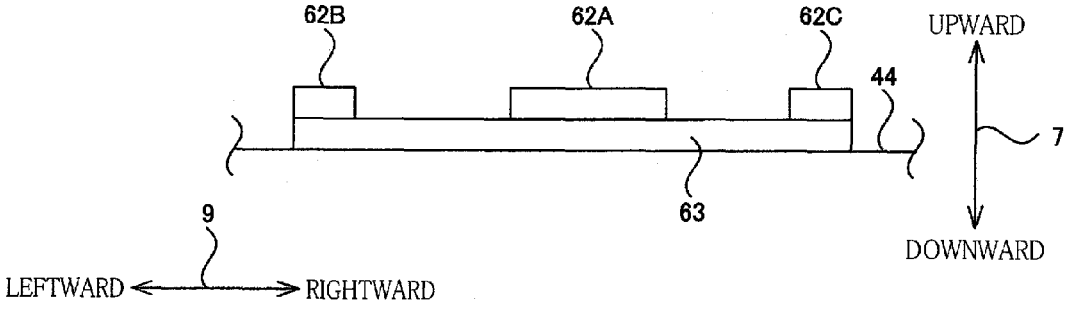

Alternatively, the dynamic vibration absorbing device may consist of the single elastic member 63 and a plurality of weight members 62, for instance, three weight members 62A, 62B and 62C, as shown in FIG. 10B. In this modification, the central weight member 62A has a diameter larger than that of the two outer weight members 62B and 62C, so that the mass m of the dynamic vibration absorbing device is larger at its central portion than at its opposite end portions, whereby the dynamic vibration absorbing device has a lower resonance frequency at its central portion than at its opposite end portions.

In the illustrated embodiment and the second modification, the dynamic vibration absorbing device has the single weight member 62 and the single elastic member 63, or alternatively, the single weight member 62 or the single elastic member 63. In other words, at least one of the weight and elastic members of each of the above-described first and second vibration dampers is provided by a one-piece member (62, 63; 62; 63) commonly used for the first and second vibration dampers.

Third Modification

In the illustrated embodiment, the carriage drive motor 96 provided as the drive power source for driving the carriage 38 is fixed to the guide rail 44, and the vibration damper 61 is disposed on the upper surface of the guide rail 44. Namely, the vibration damper 61 is disposed on one of the two guide rails 43, 44 to which the carriage drive motor 96 is fixed. However, the vibration damper 61 may be disposed on the guide rail 43 to which the carriage drive motor 96 is not fixed. Further, the vibration damper 61 may be disposed on both of the two guide rails 43, 44.

Fourth Modification

Figure 9C:
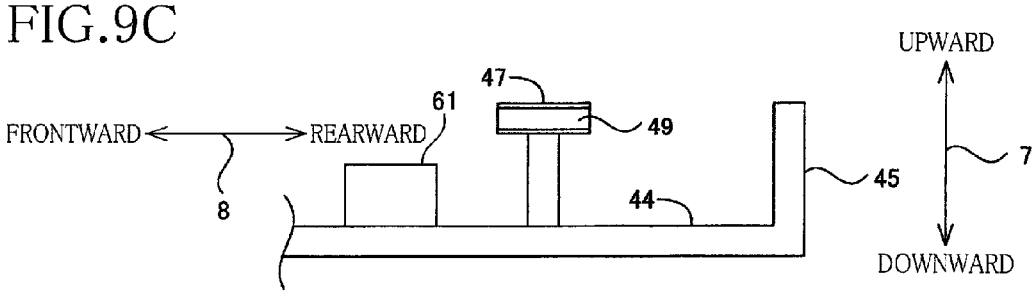
FIG. 9C is a cross sectional view taken along line A-A in FIG. 5 where the vibration damper 61 is not disposed right below a belt 49.

In the illustrated embodiment, the vibration damper 61 is disposed right below the belt 49. However, the vibration damper 61 may be spaced from the belt 49 in the sheet feeding direction 8, as shown in FIG. 9C. That is, the vibration damper 61 need not be disposed right below the belt 49.

What is claimed is:

1. An ink-jet recording apparatus comprising:

a recording head configured to eject droplets of an ink;

a carriage on which the recording head is mounted;

a support portion configured to support the carriage such that the carriage is reciprocally movable in a first direction;

a drive power source;

a power transmission mechanism configured to transmit a drive force from the drive power source to the carriage; and a vibration damping device disposed on the support portion, and wherein the vibration damping device has mutually different resonance frequency values at respective at least two different positions in the first direction.

2. The ink-jet recording apparatus according to claim 1, wherein the at least two different positions in the first direction are a first-carriage position and a second-carriage position spaced from the first-carriage position in the first direction, and the mutually different resonance frequency values are a resonance frequency value when the carriage is located at the first-carriage position, and a resonance frequency value when the carriage is located at the second-carriage position.

3. The ink-jet recording apparatus according to claim 1, wherein the vibration damping device includes a first vibration damper located at a first position in the first direction, and a second vibration damper which is located at a second position spaced from the first position in the first direction and the resonance frequency value of which is different from that of the first vibration damper.

4. The ink-jet recording apparatus according to claim 3, wherein the resonance frequency value of the first vibration damper is equal to that of the support portion when the carriage is located at a first-carriage position, and the resonance frequency value of the second vibration damper is equal to that of the support portion when the carriage is located at a second-carriage position.

5. The ink-jet recording apparatus according to claim 4, wherein the support portion includes a first support portion and a second support portion which are spaced apart from each other in a second direction intersecting the first direction, and wherein the power transmission mechanism, and the first and second vibration dampers are disposed on the first support portion.

6. The ink-jet recording apparatus according to claim 3, wherein the power transmission mechanism includes an endless belt member disposed on the support portion and rotated with the drive force transmitted thereto from the drive power source, and wherein the carriage is connected to the endless belt member and reciprocally movable in the first direction by a rotary motion of the endless belt member, and the first and second vibration dampers are disposed between the endless belt member and the support portion.

7. The ink-jet recording apparatus according to claim 3, wherein each of the first and second vibration dampers consists of a weight member and an elastic member, and wherein at least one of the weight and elastic members of each of the first and second vibration dampers is provided by a one-piece member commonly used for the first and second vibration dampers.

8. The ink-jet recording apparatus according to claim 3, wherein each of the first and second vibration dampers are spaced apart from each other in the first direction.

9. An ink-jet recording apparatus comprising:

a recording head configured to eject droplets of an ink;

a carriage on which the recording head is mounted;

a support portion configured to support the carriage such that the carriage is reciprocally movable in a first direction;

a drive power source;

a power transmission mechanism configured to transmit a drive force from the drive power source to the carriage; and a vibration damping device disposed on the support portion and including a first vibration damper located at a first position in the first direction, and a second vibration damper which is located at a second position spaced from the first position in the first direction and the resonance frequency value of which is different from that of the first vibration damper, and wherein the resonance frequency value of the first vibration damper is equal to that of the support portion when the carriage is located at a first-carriage position, and the resonance frequency value of the second vibration damper is equal to that of the support portion when the carriage is located at a second-carriage position, and further wherein each of the first and second vibration dampers consists of a weight member and an elastic member, and at least one of the weight and elastic members of each of the first and second vibration dampers is provided by a one-piece member commonly used for the first and second vibration dampers.

10. An ink-jet recording apparatus comprising:

a recording head configured to eject droplets of an ink;

a carriage on which the recording head is mounted;

a support portion configured to support the carriage such that the carriage is reciprocally movable in a first direction;

a drive power source;

a power transmission mechanism configured to transmit a drive force from the drive power source to the carriage; and a vibration damping device disposed on the support portion and including a first vibration damper located at a first position in the first direction, and a second vibration damper which is located at a second position spaced from the first position in the first direction and the resonance frequency value of which is different from that of the first vibration damper, and wherein the resonance frequency value of the first vibration damper is equal to that of the support portion when the carriage is located at a first-carriage position, and the resonance frequency value of the second vibration damper is equal to that of the support portion when the carriage is located at a second-carriage position, and further wherein each of the first and second vibration dampers are spaced apart from each other in the first direction.

* * * * *